US009217255B2

(12) United States Patent
Mork et al.

(10) Patent No.: US 9,217,255 B2
(45) Date of Patent: Dec. 22, 2015

(54) SELF-JACKING SCAFFOLD FOR LARGE CYLINDRICAL TANKS

(71) Applicants: Chicago Bridge & Iron Company, Plainfield, IL (US); OM Engineering, Miami (AU)

(72) Inventors: Oliver Mork, Miami (AU); Marty Tellalian, Bloomfield, NJ (US); Don Horacek, Bloomfield, NJ (US); Glenn Riley, Bloomfield, NJ (US); Andy Edenburn, Bloomfield, NJ (US); Al Garza, Bloomfield, NJ (US); Joseph Kucic, Bloomfield, NJ (US)

(73) Assignees: Chicago Bridge & Iron Company, Plainfield, IL (US); OM Engineering, Miami (AU)

( * ) Notice: Subject to any disclaimer, the term of this patent is extended or adjusted under 35 U.S.C. 154(b) by 0 days.

(21) Appl. No.: 14/090,901

(22) Filed: Nov. 26, 2013

(65) Prior Publication Data

US 2014/0151153 A1 Jun. 5, 2014

Related U.S. Application Data

(60) Provisional application No. 61/731,953, filed on Nov. 30, 2012.

(51) Int. Cl.
*E04G 3/20* (2006.01)
*E04G 3/28* (2006.01)
(Continued)

(52) U.S. Cl.
CPC .. *E04G 3/28* (2013.01); *E04G 3/20* (2013.01); *E04G 3/243* (2013.01); *E04G 3/246* (2013.01); *E04G 5/062* (2013.01); *E04G 5/10* (2013.01); *E04G 2003/286* (2013.01); *Y10T 29/49826* (2015.01)

(58) Field of Classification Search
CPC ..... E04G 3/20
USPC ..... 182/82, 128; 249/20
See application file for complete search history.

(56) References Cited

U.S. PATENT DOCUMENTS 2,794,242 A * 6/1957 Evers et al. ..... 29/429
4,082,161 A 4/1978 Johnson
(Continued)

FOREIGN PATENT DOCUMENTS

JP 2965982 B1 10/1999

OTHER PUBLICATIONS

International Search Report and Written Opinion issued in corresponding International Application No. PCT/US2013/072299; Dated Apr. 21, 2014 (10 pages).

*Primary Examiner* — Alvin Chin-Shue
(74) *Attorney, Agent, or Firm* — Osha Liang LLP

(57) ABSTRACT

An apparatus and method for raising a self-jacking scaffold system including extending a jacking screw and jacking screw bracket axially upward, connecting a jacking screw bracket to an overhead tank bracket for a plurality of scaffold sections coupled to a jacking assembly, detaching a plurality of scaffold mounting brackets from a plurality of tank mounting brackets, raising the continuously coupled plurality of scaffold sections, and reattaching the plurality of scaffold mounting brackets to a plurality of tank mounting brackets. Noting the plurality of scaffold sections is continuously coupled proximate a circumference of a shell tank, the continuously coupled scaffold sections and tank mounting brackets provide stiffness to the tank shell to enable it to resist external loads and can be quickly moved and restored as required during tank construction.

13 Claims, 5 Drawing Sheets

(51) Int. Cl.

| | |
|---|---|
| ***E04G 3/24*** | (2006.01) |
| ***E04G 5/06*** | (2006.01) |
| ***E04G 5/10*** | (2006.01) |

(56) References Cited

U.S. PATENT DOCUMENTS

| | | | | | |
|---|---|---|---|---|---|
| 4,540,150 | A | * | 9/1985 | Tzincoca | 249/20 |
| 5,000,287 | A | * | 3/1991 | Schwörer | 182/82 |
| 5,105,590 | A | | 4/1992 | Dykmans | |
| 5,263,835 | A | * | 11/1993 | Schmidt | 425/64 |
| 5,492,303 | A | * | 2/1996 | Jaruzel | 249/4 |
| 5,575,748 | A | * | 11/1996 | Budde et al. | 493/477 |
| 6,036,165 | A | | 3/2000 | Lee | |
| 7,513,480 | B2 | * | 4/2009 | Bergaretxe et al. | 249/20 |
| 8,585,324 | B2 | * | 11/2013 | Palfinger | 405/196 |
| 8,595,989 | B1 | * | 12/2013 | Greene | 52/82 |
| 2003/0052249 | A1 | * | 3/2003 | Waldschmitt et al. | 249/20 |

* cited by examiner

SELF-JACKING SCAFFOLD FOR LARGE CYLINDRICAL TANKS

BACKGROUND

1. Field

The present disclosure relates to methods and devices for building large cylindrical tanks. More particularly, the present disclosure relates to a self-jacking scaffold for construction of large cylindrical tanks and to resist wind loads and other external loads.

2. Background Art

When constructing large storage tanks, the great height of the structure often requires that the tank be built in levels from the ground up. As these tank structures may be as tall as 40 m they are subject to wind loads. Conventional tank construction uses a large top stiffener and intermediate stiffeners to resist wind loads during construction. Typically, the top stiffener is also designed to serve as the scaffold at the top of the tank and provides access for construction. Top stiffeners, which also serve as the scaffold, are typically composed of plate girders.

Conventionally, scaffold systems may include a continuous scaffold that runs along a perimeter of the tank shell. Due to their great size, these structures are often assembled on the ground and attached to the tank shell in sections, each segment raised as the height of the tank increases. The top stiffener or scaffold is typically placed along the circumference of a tank shell. As construction continues and the scaffold must be raised to a greater height, the continuity of the top stiffener is broken to allow movement of the sections. As a result, the stiffener no longer provides the necessary stiffness for the shell to resist moderate wind loads.

This may pose a problem for large diameter tanks subjected to high wind loads, which require the top stiffener or scaffold to maintain the stiffness of the tank shell even as each section of the scaffold is raised. In order to minimize damage caused by wind loads the scaffold must be quickly detached, raised, and reattached to the tank shell. However, due to the size and weight of the scaffold sections as well as the accessibility of the connections between the sections, this process is often time consuming.

SUMMARY

In one aspect, embodiments disclosed herein relate to a scaffold system including a plurality of scaffold sections including a first top frame element disposed proximate a circumference of a tank shell, a second top frame element disposed a radial distance from the first top frame element, and a lower frame element disposed axially below the first top frame element, and a space frame truss, wherein the space frame truss connects the first top, second top, and lower frame elements. The scaffold system also includes a plurality of self-jacking assemblies including a jacking assembly frame, a jacking screw, and a jacking screw bracket, wherein the plurality of jacking assemblies are coupled to at least one scaffold section. The scaffold system also includes at least one push-pull bar assembly coupled to at least one of the plurality of scaffold sections or at least one of the self-jacking assemblies, wherein the at least one push-pull bar assembly comprises a pair of push-pull bars wherein a first end of a first push-pull bar and a first end of a second push-pull bar are coupled to a portion of the scaffold system and wherein a second end of the first push-pull bar and a second end of the second push-pull bar extend toward the tank shell and attach to a scaffold mounting bracket.

In another aspect, embodiments disclosed herein relate to a method for assembling a self-jacking scaffold system including assembling a plurality of scaffold sections proximate a circumference of the tank shell, coupling a plurality of jacking assemblies to selected scaffold sections of the plurality of scaffold sections, attaching the plurality of scaffold sections to the circumference of the tank shell, and connecting each of the plurality of scaffold sections to an adjacent scaffold section forming a continuous ring proximate the circumference of the tank shell.

In another aspect, embodiments disclosed herein relate to a method for raising a self-jacking scaffold system including extending a jacking screw and jacking screw bracket axially upward, connecting the jacking screw bracket to an overhead tank bracket for each of a plurality of scaffold sections coupled to a jacking assembly, where the plurality of scaffold sections are continuously coupled proximate a circumference of a tank shell, the jacking screw bracket is coupled to the jacking assembly, and the overhead tank bracket is coupled to the circumference of the tank shell above the plurality of continuously coupled scaffold sections, detaching a plurality of scaffold mounting brackets from a plurality of tank mounting brackets, wherein the plurality of scaffold mounting brackets extend from the continuously coupled plurality of scaffold sections toward the tank shell, raising the continuously coupled plurality of scaffold sections simultaneously, and reattaching the plurality of scaffold mounting brackets to a plurality of tank mounting brackets.

In another aspect, embodiments disclosed herein relate to a scaffold system including a plurality of scaffold sections including a top plate element disposed proximate and approximately perpendicular a circumference of a tank shell, a lower frame element disposed axially below the top frame element, and a truss system, wherein the truss system connects the top plate element to the lower frame element in three dimensions. The scaffold system also includes a plurality of self-jacking assemblies including a jacking assembly frame, a jacking screw, and a jacking screw bracket, wherein the plurality of jacking assemblies are coupled to at least one scaffold section. The scaffold system also includes at least one push-pull bar assembly coupled to at least one of the plurality of scaffold sections or at least one of the self-jacking assemblies, wherein at least one push-pull bar assembly comprises a pair of push-pull bars wherein a first end of a first push-pull bar and a first end of a second push-pull bar are coupled to a portion of the scaffold system and wherein a second end of the first push-pull bar and a second end of the second push-pull bar extend toward the tank shell and attach to a scaffold mounting bracket.

In yet another aspect, embodiments disclosed herein relate to a self-jacking assembly including a jacking assembly frame, a jacking screw, a jacking screw bracket; and at least one push-pull bar assembly, configured to extend from the self-jacking assembly toward a tank shell.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Generally, embodiments disclosed herein relate to methods and devices for building large tanks. More specifically, the present disclosure relates to a method and device for assembling and raising a self-jacking scaffold for large tank construction.

Embodiments of the present disclosure may provide for the construction of a large cylindrical tank. Those of ordinary skill in the art will appreciate that the apparatuses and methods disclosed herein may be used for the construction of a large tank of any shape, for example, cylindrical, square, etc. Thus, as used herein, the term "tank shell" is not meant to limit the scope of this disclosure to just cylindrical tanks.

Figure 1:
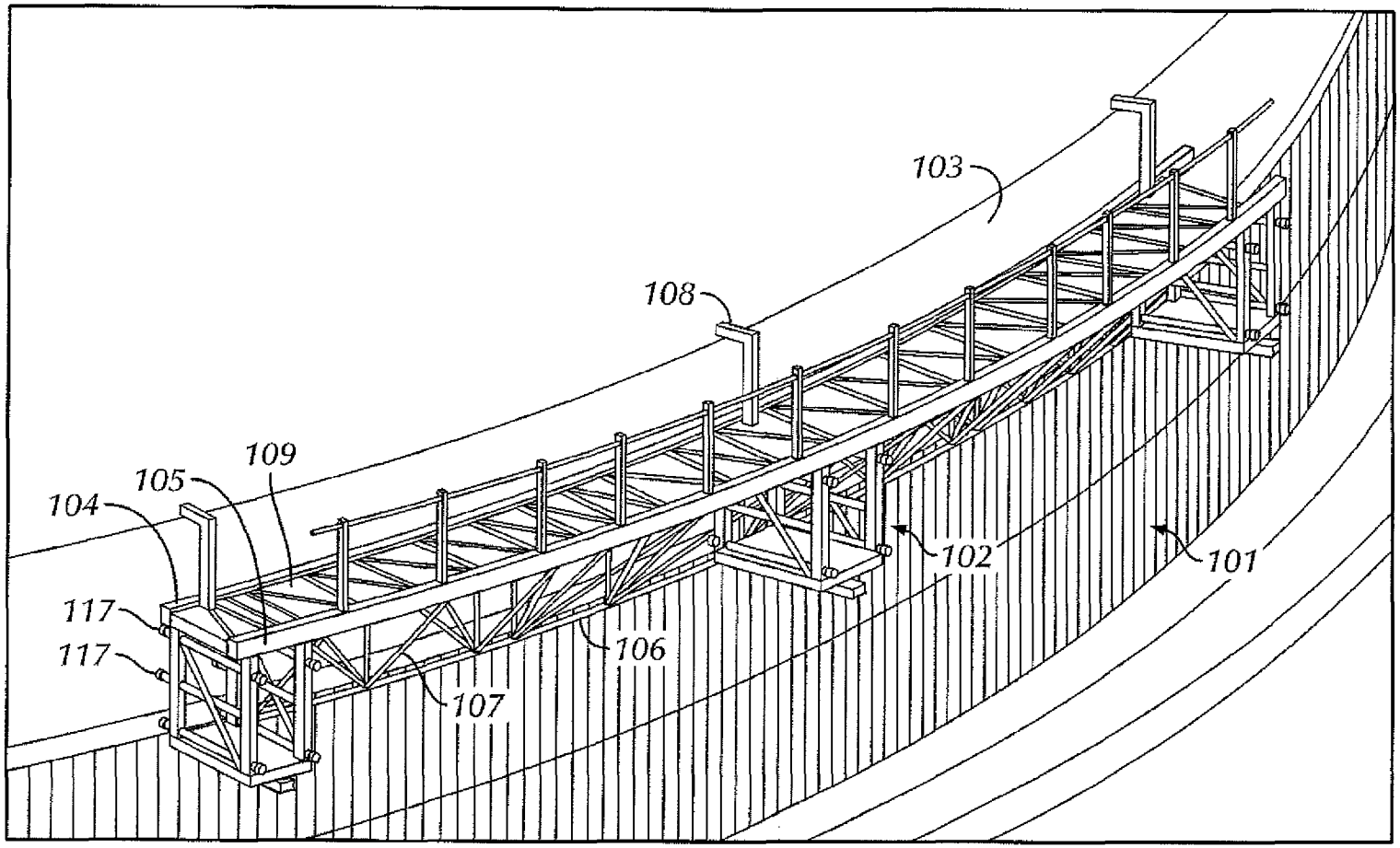
FIG. 1 is a perspective view of a section of a scaffold and jacking assembly attached to a shell of a large cylindrical tank in accordance with embodiments of the present disclosure.

Referring initially to FIG. 1, a perspective view of a scaffold section 101 is shown attached to a portion of a tank shell 103. A self-jacking scaffold system may include a plurality of scaffold sections 101 and a plurality of jacking assemblies 102. The plurality of scaffold sections 101 may be disposed on an outer circumference of the tank shell 103 such that when the scaffold sections 101 are joined a plurality of continuous scaffold sections 101 form a ring around the circumference of the tank shell 103. In some embodiments, the plurality of scaffold sections 101 may be disposed on an inner circumference of the tank shell. One of ordinary skill in the art will understand that the scaffold sections are disposed proximate the tank shell such that axial movement of the scaffold section will move past attachments protruding from the tank shell 103 such as intermediate stiffeners, tank brackets 117, and overhead brackets 129 without contact. In other words, a clearance exists between the attachments and the scaffold so that the scaffold may move past the attachments without interference.

Each of the plurality of jacking assemblies 102 may be coupled to at least one scaffold sections 101. In certain embodiments, scaffold sections 101 not coupled to a jacking assembly 102 may be adjacent to at least one scaffold section 101 coupled to a jacking assembly 102. Those of ordinary skill in the art will appreciate that the placement or distribution of jacking assemblies 102 may vary without departing from the scope of the embodiments disclosed herein. For example, the scaffold sections 101 coupled to a jacking assembly 102 may be irregularly distributed around the circumference of the tank shell 103 such that some scaffold sections 101 not coupled to a jacking assembly 102 may be adjacent to two scaffold sections 101 not coupled to a jacking assembly 102, while some scaffold sections 101 not coupled to a jacking assembly 102 may be adjacent to at least one scaffold section 101 coupled to a jacking assembly 102. The scaffold sections may also be regularly distributed around the circumference of the tank shell 103. For example, every other scaffold section 101 may be adjacent to a scaffold section 101 coupled to a jacking assembly 102, such that every scaffold section 101 not coupled to a jacking assembly 102 is adjacent to two scaffold sections 101 coupled to a jacking assembly 102.

Figure 2:
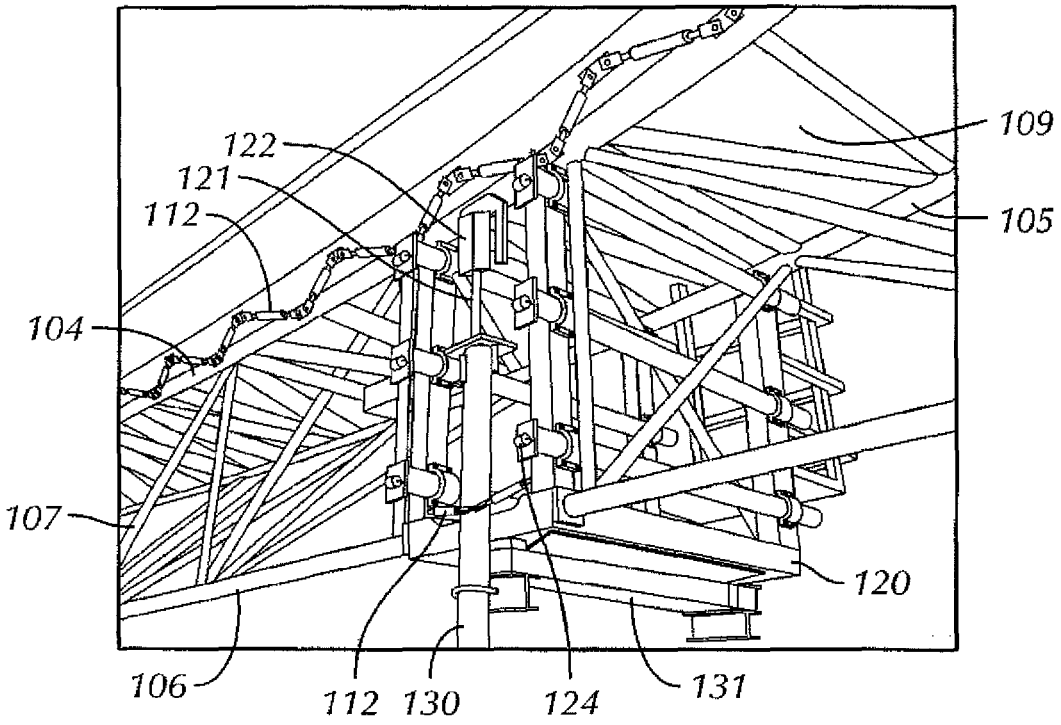
FIG. 2 is a cutaway view of the scaffold sections and jacking assembly of FIG. 1

Referring now to FIG. 2 for scaffolds located on the outer surface of the tank shell, a scaffold section may include a first top frame element 104 disposed proximate the outer circumference of a tank shell 103, an second top frame element 105 disposed radially outward from the first top frame element 104, and a lower frame element 106 disposed axially below the first top frame element 104. A space frame truss 107 runs between the first top frame element 104, second top frame element 105, and lower frame element 106. The space frame truss 107 connects the three frame elements in three dimensions while providing additional structural stiffness with a low weight. Due to the stiffness of the continuous scaffold ring provided by the continuity of the three frame elements as well as the space frame truss 107, the plurality of continuous scaffold sections 101 may act as a top stiffener.

Figure 6:
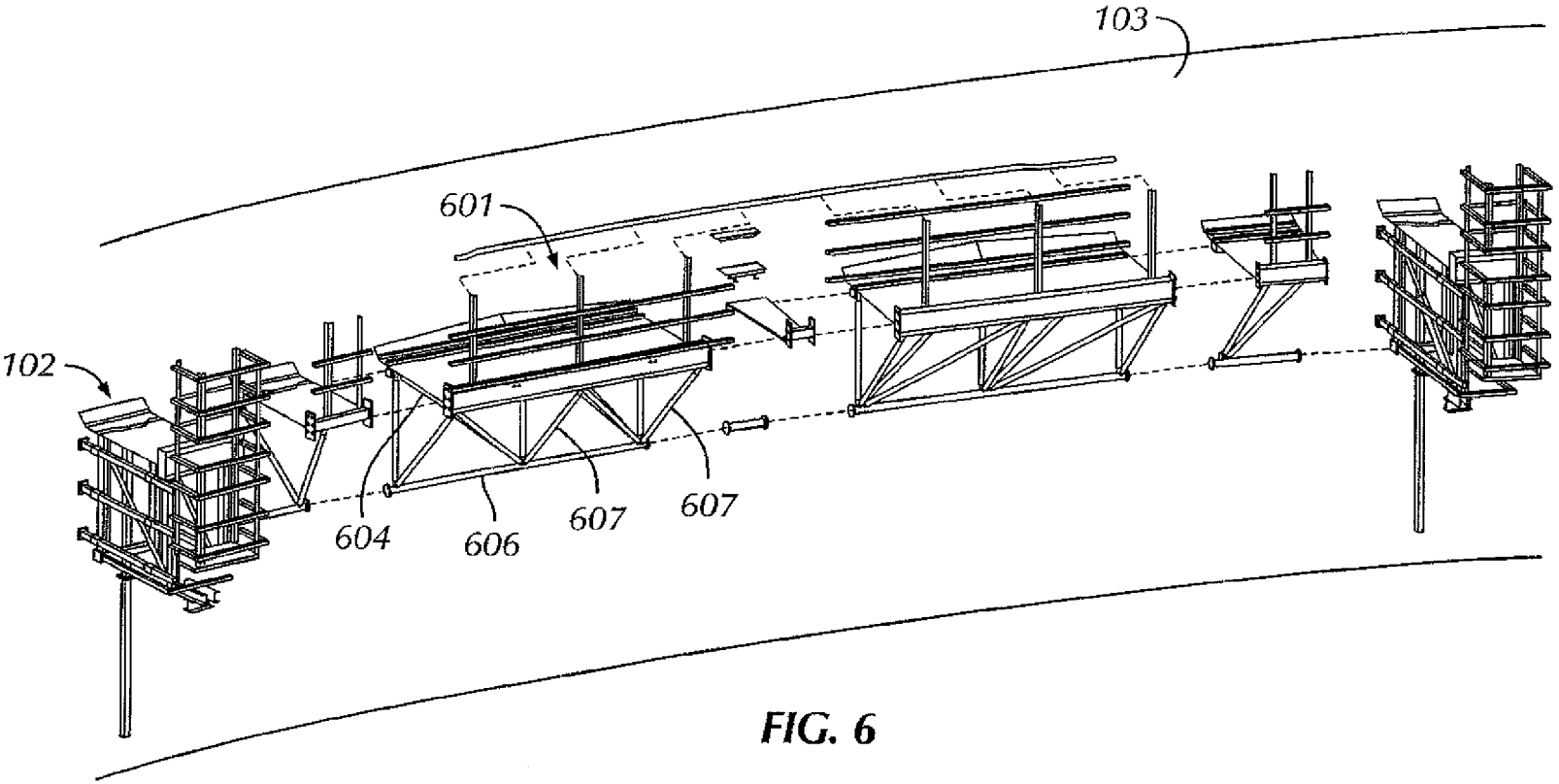
FIG. 6 is a perspective view of a section of a scaffold and jacking assembly in accordance with embodiments of the present disclosure.

As seen in FIG. 6, in some embodiments, the scaffold section 601 may be a plate girder scaffold and include a top plate element 604. As seen in FIG. 6, top plate element 604 is disposed proximate the inner circumference of a tank shell 103 and is positioned approximately perpendicular to the tank shell. In other embodiments, the scaffold section 601 may be disposed proximate an outer circumference. The top plate element 604 acts as a load bearing member and contributes to the strength and stiffness of the scaffold 601. The top plate element 604 may also act to stiffen the tank shell. A lower frame element 606 is disposed axially below the top plate element 604 proximate the circumference of the tank shell. A truss frame 607 connects top plate element 604 to lower frame element 606 in three dimensions to provide additional stiffness and rigidity to the scaffold 601 and the tank shell 103. Larger tank shells typically experience higher loads. For large tank shells, the top plate element will correspondingly increase in size and/or weight to support the higher loads. Therefore, the plate girder scaffold section 601 may be more appropriate for use with smaller diameter tanks or large tanks that do not experience high loads, while the scaffold section 101 may be more appropriate for use with larger diameter tanks.

Figure 4:
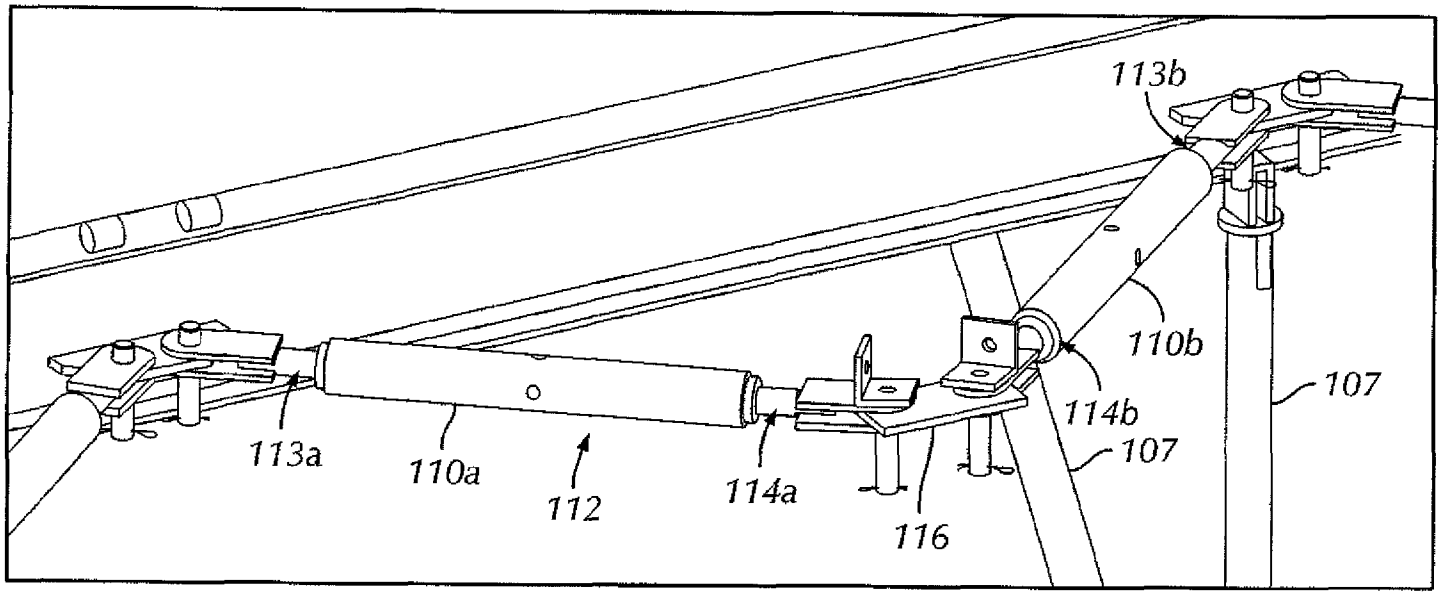
FIG. 4 is an enlarged view of a push-pull assembly in accordance with embodiments of the present disclosure.

As seen in FIG. 2, a plurality of push-pull bar assemblies 112 extend from the scaffold section 101 toward the tank shell 103. Push-pull bar assemblies 112 may similarly be coupled to scaffold sections 601 (FIG. 6). FIG. 4 shows a close-up view of a push-pull bar assembly 112. A push-pull bar assembly 112 may include a pair of push-pull bars 110 arranged such that a first end 113*a* of a first push-pull bar 110*a* and a first end 113*b* of a second push-pull bar 110*b* are mounted along a component of the scaffold section 101, for example the first top frame element 104. The respective second ends 114*a* and 114*b* of push-pull bars 110*a* and 110*b* extend toward the shell tank 103 and are coupled to a scaffold mounting bracket 116. First end 113 of a push-pull bar 110 may be coupled to the scaffold section 101 using, for example, brackets, welding, or other mechanical mounting means known in the art. In some embodiments, the length of the push-pull bars 110 may be adjustable. The push-pull bars may include a turnbuckle, screw, or any mechanism to adjust the length of a member as known in the art.

Figure 5:
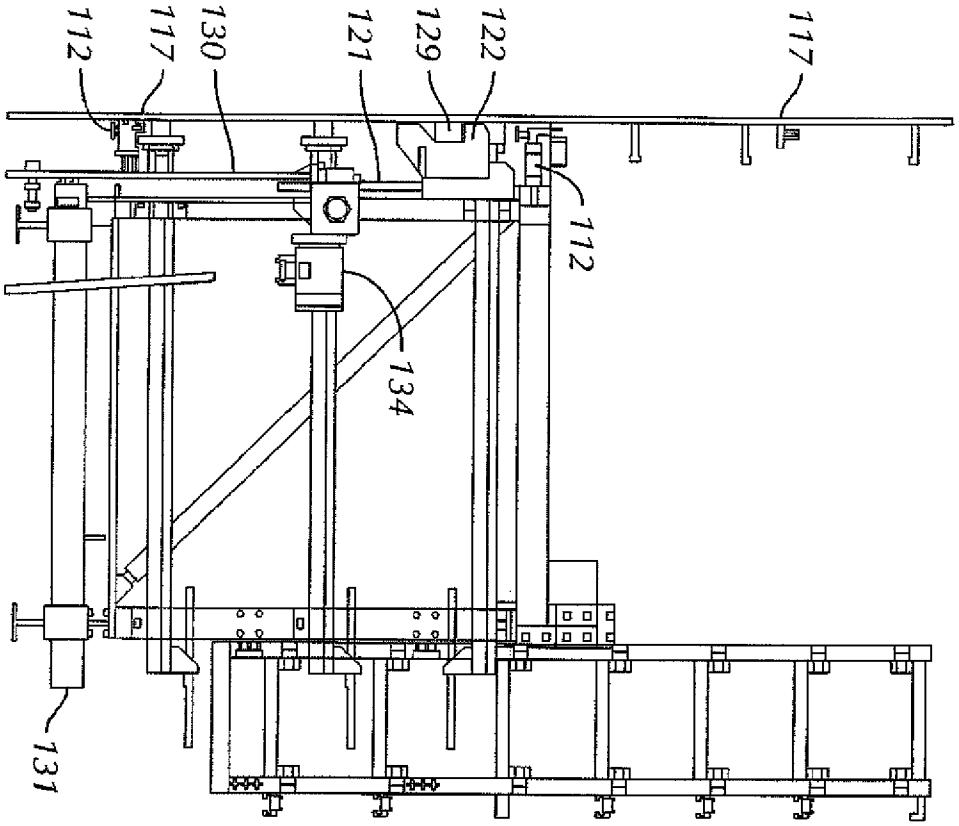
FIG. 5 is a side view of a jacking assembly in accordance with embodiments of the present disclosure.

The scaffold mounting brackets 116 may be coupled to tank brackets 117 that have been welded to the circumference of the tank shell 103, as shown in FIG. 5. Scaffold mounting brackets 116 may be coupled to tank brackets 117 using, for example bolts, screws, rivets, or other mechanical fasteners.

Those of ordinary skill in the art will appreciate that the specific type of attachment is not a limitation on the scope of the present disclosure.

In some embodiments, a scaffold platform 109 may be positioned on the first top frame element 104 and extend to second top frame element 105 forming a planar work surface, as shown in FIG. 1. The scaffold platform 109 should be able to support workers erecting the tank while being able to withstand external loads such as high wind loads and adverse weather conditions. The scaffold platform 109 may be formed of any material such as wood, metal or other durable planar material known in the art. The scaffold platform 109 may be attached to the first and second top frame elements 104, 105 using bolts, rivets, screws, or any other durable mechanical fastener known in the art. In embodiments in accordance with scaffold section 601 shown in FIG. 6, the top plate element 604 may act as a scaffold platform. Additional railings may be coupled to the scaffold platform 109 or top plate element 604 as a safety precaution. Enclosures and panels may be coupled to the scaffold section 101, 601 to allow the scaffold to be used as a weather enclosure or shroud.

Referring to FIGS. 2 and 5, the plurality of jacking assemblies 102 each include a jacking assembly frame 120, a jacking screw 121, a jacking screw bracket 122, and may have at least one pair of push-pull bars 112 mounted to the jacking assembly frame 120. The jacking assembly frame 120 may be rectangular in shape, however, those of ordinary skill in the art will appreciate that the specific shape of the frame is not a limitation on the scope of the present disclosure. In some embodiments, the jacking assembly frame 120 may span the radial width of the scaffold platform 109 such that a first side of the jacking assembly frame 120 is proximate the first top frame element 104 and a second side of the jacking assembly frame 120 is proximate the second top frame element 105. In some embodiments, the jacking assembly frame 120 may span the radial width of top plate element 604 such that a first side of jacking frame assembly is proximate a first side of the top plate element and a second side of jacking frame assembly is proximate a second side of top plate element 604. One of ordinary skill in the art will understand that the width of the jacking assembly frame is not meant to be a limitation on the present disclosure. For example, in some embodiments, the jacking assembly frame 120 may not span the entire radial width of the top plate element 604 or scaffold platform 109.

Referring to FIGS. 2 and 5, in some embodiments, the push-pull bar assembly 112 may be coupled to a first side of jacking assembly proximate the lower frame element 106. Similar to the push-pull bar assemblies coupled to the scaffold sections, push-pull bar assemblies 112 coupled to the jacking assembly extend toward the shell tank 103 and may be coupled to tank brackets 117 that have been welded to the circumference of the tank shell 103, as seen in FIG. 5. One having ordinary skill in the art will understand that the location of the push-pull bars is not intended to limit the scope of the present application. For example, the push-pull bars may be coupled to the scaffold sections 101, 601 and/or the jacking assemblies 102 without departing from the scope of the present disclosure.

In some embodiments a plurality of rollers 124 may be attached to the jacking assembly frame 120. The rollers 124 may be in contact with the tank shell 103 to stabilize the plurality of continuous scaffold sections 101. The rollers 124 may also guide the plurality of continuous scaffold sections 101 as it is being raised or lowered. In some embodiments vertical guide beams (not shown) may be coupled to the jacking assembly frame 120. The tank shell 103 (FIG. 1) may have a plurality of protrusions welded thereto. However, these protrusions may obstruct the path of rollers 124 and deflect rollers 124 to the side. Therefore, vertical guide beams may be included to control the position of roller wheels during operation of the jacking assembly 102.

Figure 3:
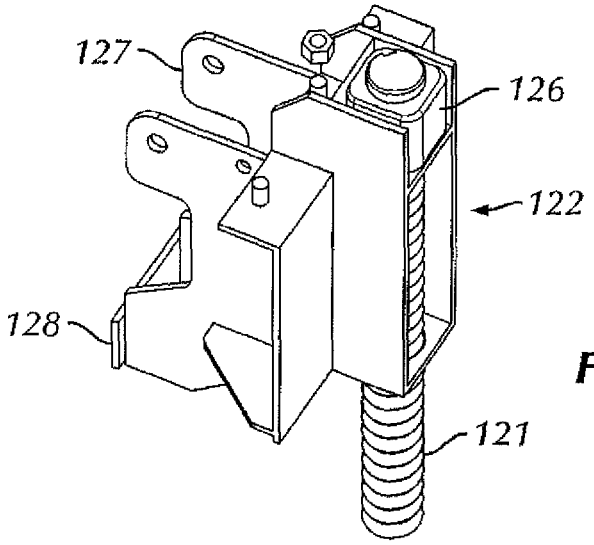
FIG. 3 is an enlarged view of a jacking screw in accordance with embodiments of the present disclosure.

FIG. 3 shows an enlarged view of the jacking screw 121 and the jacking screw bracket 122. The jacking screw bracket 122 may be attached to the jacking screw assembly frame by, for example, welding, bolting, or any fastening means known in the art. The jacking screw 121 may be any jacking screw known in the art. In some embodiments the jacking screw 121 may be less than 2 m long. In some embodiments the jacking screw may be between approximately 2 and 5 meters. The lengths provided are exemplary and are not intended to limit the scope of the disclosure. In some embodiments, a reduced length of the jacking screw 121 corresponds to a reduced height of the overall scaffold system.

In some embodiments, as seen in FIG. 2, a portion of the jacking screw 121 may be encased in a jacking screw shield 130. The jacking screw shield 130 may be attached to the jacking screw bracket 122. Referring to FIG. 2, the jacking screw shield 130 is bolted below the jacking screw bracket. However, several coupling means may be used to attach the jacking screw shield 130 to the jacking screw bracket 122, for example, rivets, screws or other mechanical fasteners. A jacking screw brace 131 may be coupled to the jacking screw shield 130 in order to add rigidity to jacking screw shield. The jacking screw brace 131 may be coupled to underside of the jacking screw assembly frame 120, such that the jacking screw brace 131 extends radially outward from where it is coupled to the jacking screw shield 130, as seen in FIGS. 2 and 5. The jacking screw brace 131 may be attached to the underside of jacking screw frame 120 using welding, bolts, rivets, or other fastening means known in the art.

The jacking screw bracket 122 may include jacking screw mount 126, at least one bolt flange 127, and a push bar 128. The jacking screw mount 126 provides an interface for jacking screw 121. The bolt flange 127 protrudes from the jacking screw bracket 122 toward the tank shell 103 so that it may couple to an overhead bracket 129 welded to the tank shell 103. The bolt flange 127 may be attached to the overhead bracket 129 using, for example, bolts, rivets, screws, or other mechanical fasteners known in the art.

While bolt flange 127 is attached to overhead brackets 129 it creates a force that pulls radially outward from the tank shell 103. Push bar 128 is disposed on jacking screw bracket and in contact with the tank shell 103 to provide a force pushing inward. Thus, the force acting at the bolt flange 127 and the force acting at the push bar 128 create a force couple. One having ordinary skill in the art would understand that the jacking screw bracket, including the bolt flange and the push bar, may be modified based on the size of the tank and the loading experienced by said tank.

Referring to FIG. 5, in some embodiments, at least one motor 134 may be coupled to the jacking assembly and the plurality of jacking screws 121. The motor 134 may be in communication with a central control module (not shown). In some embodiments one motor 134 may be coupled to each of plurality of jacking screws 121. The plurality of motors may be in communication with a central control module which may coordinate the operation of the motors so that the motors may be run simultaneously.

Referring to FIG. 2, in some embodiments the jacking assembly 102 may be fabricated as a standardized unit. This reduces the amount of assembly required on site. Additionally, a standardized jacking assembly may allow the jacking assemblies to be used for multiple sites without requiring fabrication of a new jacking assembly for a new site. For example, a plurality of standardized jacking assembly units may be fabricated for a first site. The same plurality of standardized jacking assembly units may be used for a second site. If the tank requirements are different between the first and second site, then elements of the jacking assembly may be modified accordingly. The standardized jacking units may be used for small and large tanks.

While the coupling of the jacking assembly 120 has been described largely with respect to scaffold section 101, one having ordinary skill in the art will readily understand that the jacking assembly may be coupled to scaffold section 601. The above description with respect to scaffold 101 is intended to be exemplary and is not meant to limit the scope of the present disclosure.

Referring to FIG. 1, the self-jacking scaffold system may be assembled by first erecting a tank shell 103. The tank shell 103 may be erected by welding large sheets of metal, for example, steel together to form the tank shell 103. These sheets of steel may be, for example, 2.5 meters by 10 meters or 4 meters by 14 meters and 12-25 mm thick. Once a first level of steel sheets is welded to define the circumference of the tank shell, additional steel sheets may be welded above the first level forming a second level. Thus, one may think of the tank shell 103 as being erected in levels.

In some embodiments, once the first three levels of the tank shell 103 have been erected, a plurality of scaffold sections 101 may be assembled proximate the circumference of the tank shell 103. Those of ordinary skill in the art will appreciate that the exact number of levels erected before assembling and attaching the scaffold sections 101 is not a limitation on the scope of the present disclosure, as the self-jacking scaffold system may be assembled after the first or second levels have been erected. In some embodiments, the scaffold sections 101 may be assembled proximate the inner circumference of the tank shell 103. In some embodiments, the scaffold sections 101 may be assembled proximate the outer circumference of the tank shell 103. As discussed above, some of these scaffold sections 101 may include a jacking assembly 102. The jacking assembly 102 is then coupled to the appropriate scaffold sections 101. The jacking assembly 102 may be coupled to the appropriate scaffold sections 101 by welding, bolts, screws, rivets, or other fastening means known in the art.

Once the scaffold sections 101 have been assembled and the jacking assemblies 102 have been assembled and are coupled to the appropriate scaffold sections 101, the plurality of scaffold sections 101 may be attached to the circumference of the tank shell 103. In some embodiments the scaffold sections 101 may first be attached to the tank shell 103, by an erection support 108. The erection support 108 allows workers or technicians to place each scaffold section 101 at the proper position before securing the scaffold section 101 to the tank shell 103. Once the scaffold section 101 is properly positioned the scaffold mounting bracket 116 may be bolted or otherwise mechanically fastened to a plurality of tank brackets 117 welded to the outer surface of the tank shell 103. This proper position may be determined by aligning the scaffold mounting brackets 116 to the tank brackets 117 on the surface of the tank shell 103.

Once the scaffold sections 101 have been securely coupled via the scaffold mounting brackets 116 to the tank shell 103, each scaffold section 101 may be coupled to an adjacent scaffold section 101 forming a ring of a plurality of continuously coupled scaffold sections 101. As discussed above, this plurality of continuous scaffold sections 101, including the first top, second top, and lower frame elements 104, 105, 106, and the space frame truss 107 provide stiffness to the tank shell 103 structure allowing it to resist high wind loads and adverse weather conditions that may potentially compromise the structural integrity of the tank shell 103.

Once the plurality of continuous scaffold sections 101 has been assembled, construction of the tank shell 103 may resume. As construction continues the plurality of continuous scaffold sections 101 may need to be raised to the newly built level. The plurality of continuous scaffold sections 101 may be raised by first extending the jacking screw 121, and jacking screw bracket 122 axially upward to a desired height for each of a plurality of scaffold sections. In some embodiments the desired height will be determined by the height of the overhead brackets 129. For example, the jacking screw 121 and bracket 122 may be extended until it is adjacent to an overhead bracket 129. Once the jacking screw 121 and jacking screw bracket 122 are at the desired height, the jacking screw bracket 122 may be connected to a nearby overhead bracket 129. This connecting may include bolting the bolt flange 127 of the jacking screw bracket 122 to the overhead bracket 129. This process is repeated for every scaffold section of the self-jacking scaffold system.

Once the jacking screw bracket 122 is connected to an overhead bracket 129 for each of a plurality of continuously coupled scaffold sections 101, the plurality of scaffold mounting brackets 116 may be disconnected from the plurality of tank brackets 117.

At this point, the self-jacking scaffold system is attached to the tank shell 103 through just the plurality of jacking screw brackets 122. Thus, the plurality of continuously coupled scaffold sections 101 may be raised simultaneously. This may be accomplished by turning each jacking screw 121 disposed in each of a plurality of jacking assemblies 102. In some embodiments, a plurality of rollers 124 may guide and stabilize the plurality of continuously coupled scaffold sections 101.

In some embodiments, as discussed above, at least one motor 134 may be coupled to a jacking screw 121, with the motor configured to raise or lower the jacking screw 121. In some embodiments, the motor 134 may be in communication with a control module configured to actuate and stop the motor 134. In some embodiments, a single motor 134 may be paired to a single jacking screw 121 for each of a plurality of jacking assemblies 102. The plurality of motors 134 may also be in communication with a control module. The control module will then have to sequence and operate the motors together so as to raise each scaffold section 101 simultaneously. As used herein, "simultaneously", is intended to mean that each scaffold section may rise at approximately the same time. Those of ordinary skill in the art may appreciate that because a jacking assembly 102 may not be mounted to each and every scaffold section 101 there may be a minor delay in movement for scaffold sections 101 not directly coupled to a jacking assembly 102.

In some embodiments, the plurality of continuous scaffold sections 101 may be raised to the middle of the topmost level of the tank shell 103. However, this is not meant as a limitation on the scope of this disclosure. The position of the plurality of continuous scaffold sections 101 relative to the height of each tank shell level depends on the placement of the tank brackets 117. That is to say, if the tank brackets 117 are disposed near the mid-line of a level of a tank shell 103, then the plurality of continuous scaffold sections 101 will be raised to the midline of the level. Similarly, if the tank brackets are disposed near the top of the tank shell 103, then the plurality of continuous scaffold sections 101 will also be located near the top.

When the plurality of continuous scaffold sections 101 is raised, the plurality of scaffold mounting brackets 116 may be recoupled to a second plurality of tank brackets 117 welded to the tank shell 103. In some embodiments, the length of the push-pull bars 110 may be adjusted to accommodate minor variations in the tank shell 103 before reattaching the scaffold mounting brackets 116 to the tank brackets 117.

Embodiments disclosed herein may provide for improved productivity. The plurality of continuous scaffold sections 101 may accommodate variations in the tank shell 103 and may be removed and attached quickly with hand tools. Consequently, raising the plurality of continuous scaffold sections 101 may be faster, more cost effective, and safer than current state of the art. The plurality of continuous scaffold sections 101 also acts as a top stiffener to resist external loads, so additional stiffeners may or may not be necessary to reinforce the tank structure.

In some embodiments the plurality of continuous scaffold sections may be used to erect a tank shell. In other embodiments, the plurality of continuous scaffold sections 101 may be used to perform maintenance on a surface of a tank shell, for example, welding, non-destructive examination, painting, and blasting. Although described above with respect to performing work on an exterior surface of a structure, embodiments of systems disclosed herein may also be used to work on interior portions of vertical structures.

While the disclosure includes a limited number of embodiments, those skilled in the art, having benefit of this disclosure, will appreciate that other embodiments may be devised which do not depart from the scope of the present disclosure. Accordingly, the scope should be limited only by the attached claims.

What is claimed:

1. A scaffold system for erecting a tank shell comprising:
a plurality of scaffold sections connected to the tank shell and comprising:
a first top frame element disposed proximate a circumference of a tank shell;
a second top frame element disposed a radial distance from the first top frame element;
a lower frame element disposed below the first top frame element; and
a space frame truss, wherein the space frame truss connects the first top, second top, and lower frame elements;
a plurality of self-jacking assemblies comprising:
a jacking assembly frame;
a jacking screw bracket attached to the jacking assembly frame; and
a jacking screw, wherein a portion of the jacking screw is located in the jacking screw bracket,
wherein each jacking assembly is coupled to at least one scaffold section;
wherein the plurality of scaffold sections and the plurality of jacking assemblies are connected, thereby acting as a top stiffener to stiffen the tank shell; and
at least one push-pull bar assembly coupled to at least one of the plurality of scaffold sections or at least one of the self-jacking assemblies,
wherein the at least one push-pull bar assembly comprises a pair of push-pull bars wherein a first end of a first push-pull bar and a first end of a second push-pull bar are coupled to at least one of the plurality of scaffold sections or at least one of the self-jacking assemblies and wherein a second end of the first push-pull bar and a second end of the second push-pull bar extend away from the at least one scaffold section or the at least one self-jacking assembly toward the tank shell.

2. The system of claim 1, wherein the scaffold sections not coupled to the self-jacking assembly are adjacent to at least one scaffold section coupled to the self-jacking assembly.

3. The system of claim 1, further comprising a plurality of rollers extending from the self-jacking assembly.

4. The system of claim 1, wherein a length of the at least one push-pull bar is adjustable.

5. The system of claim 1, further comprising a bracket to attach the at least one push-pull bar assembly to at least one of the plurality of scaffold sections.

6. The system of claim 1, wherein the plurality of scaffold sections are disposed along an interior circumference of the tank shell.

7. The system of claim 1, wherein a diameter of the first top frame element is smaller than a diameter of the second top frame element.

8. The system of claim 1, further comprising a scaffold platform disposed on the first top frame element extending to the second top frame element.

9. The system of claim 1, further comprising at least one motor coupled to the plurality of jacking assemblies.

10. The system of claim 9, further comprising a control module in communication with the at least one motor.

11. The system of claim 1, wherein the jacking screw bracket comprises:
a jacking screw mount;
at least one bolt flange; and
a push bar.

12. A scaffold system for erecting a tank shell comprising:
a plurality of scaffold sections connected to the tank shell and comprising:
a top plate element disposed proximate and approximately perpendicular to a circumference of a tank shell;
a lower frame element disposed below the top plate element; and
a truss system, wherein the truss system connects the top plate element to the lower frame element in three dimensions;
a plurality of self-jacking assemblies comprising:
a jacking assembly frame;
a jacking screw bracket, attached to the jacking assembly frame; and
a jacking screw, wherein a portion of the jacking screw is located in the jacking screw bracket, and
wherein each jacking assembly is coupled to at least one scaffold section;
wherein the plurality of scaffold sections and the plurality of jacking assemblies are connected, thereby acting as a top stiffener to stiffen the tank shell; and
at least one push-pull bar assembly coupled to at least one of the plurality of scaffold sections or at least one of the self-jacking assemblies,
wherein at least one push-pull bar assembly comprises a pair of push-pull bars wherein a first end of a first push-pull bar and a first end of a second push-pull bar are coupled to at least one of the plurality of scaffold sections or at least one of the self-jacking assemblies and wherein a second end of the first push-pull bar and a second end of the second push-pull bar extend away from the at least one scaffold section or at least one self-jacking assembly.

13. The scaffold system of claim 12, wherein the top plate element is a load bearing member.

* * * * *